US006012990A

United States Patent [19]

Nishizawa

[11] Patent Number: 6,012,990

[45] Date of Patent: Jan. 11, 2000

[54] GOLF CLUB HEAD

[75] Inventor: Yoh Nishizawa, Hiratsuka, Japan

[73] Assignee: The Yokohama Rubber Co., Ltd., Tokyo, Japan

[21] Appl. No.: 09/035,096

[22] Filed: Mar. 5, 1998

[30] Foreign Application Priority Data

Mar. 26, 1997 [JP] Japan ..... 9-073307

[51] Int. Cl.[7] ..... A63B 53/04

[52] U.S. Cl. ..... 473/345; 473/349

[58] Field of Search ..... 473/324, 345, 473/346, 347, 348, 349, 350, 334, 338

[56] References Cited

U.S. PATENT DOCUMENTS

| | | |
|---|---|---|
| 4,432,549 | 2/1984 | Zebelean . |
| 4,803,023 | 2/1989 | Enomoto . |
| 5,193,811 | 3/1993 | Okumoto . |
| 5,207,428 | 5/1993 | Aizawa . |
| 5,421,577 | 6/1995 | Kobayashi . |
| 5,501,459 | 3/1996 | Endo . |
| 5,658,207 | 8/1997 | Aizawa . |
| 5,755,624 | 5/1998 | Helmstetter . |

*Primary Examiner*—Sebastiano Passaniti
*Attorney, Agent, or Firm*—Finnegan, Henderson, Farabow, Garrett & Dunner, L.L.P.

[57] ABSTRACT

Disclosed is a golf club head comprising a hollow head main body comprising a metallic sole portion and a metallic outer mold which have been molded solidly together, wherein at least one part of the sole portion is formed of a heavy metal having a specific gravity which is 3.5 to 11 times the specific gravity of the metal constituting the outer mold. Also disclosed is a golf club head comprising a hollow head main body wherein a metallic sole portion and a metallic outer mold which have been molded solidly together; and wherein assuming a coordinate system wherein when the head main body is placed in a stationary position on a horizontal plane surface, a position of the center of gravity of the head main body is deemed as an origin O, a line perpendicular to the plane surface, which passes through the origin O is deemed as a Y axis, and a line parallel to the plane surface and perpendicular to a leading edge of the head main body, which passes through the origin O is deemed as an X axis, a weight is positioned in a lower left quadrant partitioned below the X axis and to the back of the Y axis, the foregoing weight being formed of a heavy metal having a specific gravity which is 3.5 to 11 times the specific gravity of the metal constituting the head main body.

4 Claims, 3 Drawing Sheets

GOLF CLUB HEAD

BACKGROUND OF THE INVENTION

The present invention relates to a golf club head having a hollow structure, and more particularly to a golf club head with a lowered center of gravity which is capable of ensuring shot stability.

A conventional metal wood golf club has a head main body comprising a metallic sole portion and a metallic outer mold which have been fixed solidly together to form a hollow structure. Furthermore, some long iron golf clubs have similar hollow-structure head main bodies.

In a golf club head having this type of hollow structure, it is regarded as important to lower the position of the center of gravity of the head in order to facilitate ball lift and to increase ball flight distance when striking the ball. In the case of the above-mentioned conventional golf club heads, various means have been adopted to lower the center of gravity, such as increasing the thickness of the sole portion or providing a weight to the inner surface of the sole portion. In addition to lowering the center of gravity as described above, it is also regarded as important in the case of a hollow golf club head to increase the moment of inertia around the head's center of gravity in order to ensure shot stability.

However, although a lower center of gravity has been achieved in conventional golf club heads by means such as increasing the thickness of the sole portion or providing a weight to the sole portion, one side effect of such means has been a reduction in the hollowness ratio of the head main body. Consequently, it has been difficult to increase the moment of inertia around the head's center of gravity which depends upon the sole portion, resulting in an insufficient improvement in shot stability.

SUMMARY OF THE INVENTION

The present invention aims to provide a golf club head which is capable of lowering the center of gravity while also ensuring shot stability.

In order to achieve the above objectives, the golf club head of the present invention comprises a hollow head main body having a metallic sole portion and a metallic outer mold which have been molded solidly together, wherein at least one part of the foregoing sole portion is formed of a heavy metal having a specific gravity which is 3.5 to 11 times the specific gravity of the metal constituting the foregoing outer mold.

Since at least one part of the sole portion is formed of a heavy metal which differs from the metal of which the outer mold is formed, the center of gravity can be lowered without increasing the thickness of the sole portion more than is necessary, thereby facilitating lift when a ball is struck and increasing ball flight distance, as well as enabling the moment of inertia around the center of gravity of the head to be increased by increasing hollowness ratio of the head main body, thereby improving shot stability.

Furthermore, a golf club head of the present invention comprises a hollow head main body having a metallic sole portion and a metallic outer mold which have been molded solidly together; and wherein, assuming a coordinate system in which when the foregoing head main body is placed in a stationary position on a horizontal plane surface, a position of the center of gravity of the foregoing head main body is deemed as an origin O, a line which passes through the origin O perpendicular to the foregoing horizontal plane surface is deemed as a Y axis, and a line which passes through the origin O parallel to the foregoing horizontal plane surface and perpendicular to a leading edge of the foregoing head main body is deemed as an X axis, a weight is positioned in a lower left quadrant partitioned below the foregoing X axis and to the back of the foregoing Y axis, the foregoing weight comprising a heavy metal having a specific gravity which is 3.5~11 times the specific gravity of the metal constituting the foregoing head main body.

By providing a weight, which comprises a heavy metal different to the metal from which the head main body is comprised, below the center of gravity position of the head and to the back side thereof, the center of gravity of the head is lowered and the depth of the center of gravity (namely, the distance from the shaft center line to the center of gravity) is increased, thereby facilitating lift and improving shot stability when a golf ball is struck.

Providing that the head main body has a hollow structure, the golf club head of the present invention can be applied to both a metal wood golf club and a long iron golf club.

For a more complete understanding of the present invention and the advantages thereof, reference is now made to the following description taken in conjunction with the accompanying drawings.

DETAILED DESCRIPTION OF THE PREFERRED EMBODIMENTS

Figure 1:
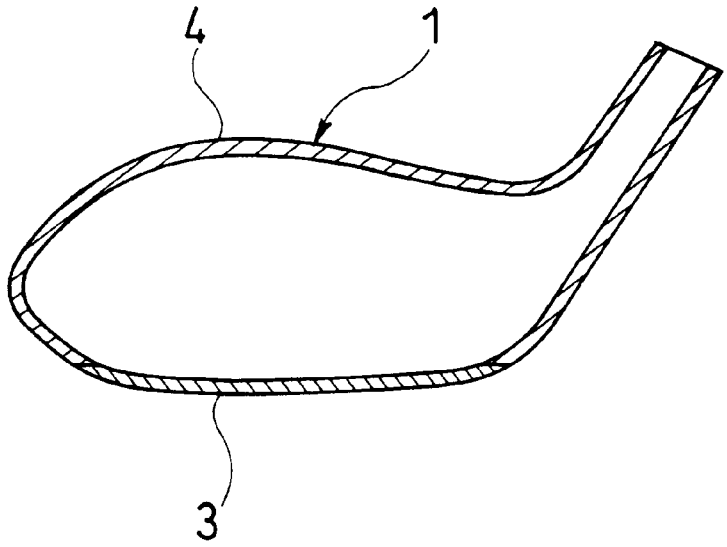
FIG. 1 is a vertical cross-sectional front view illustrating a metal wood golf club head according to a first embodiment of the present invention.

FIG. 1 depicts a metal wood golf club head according to a first embodiment of the present invention. In FIG. 1, a head main body 1 has a hollow structure comprising a metallic sole portion 3 and a metallic outer mold 4 which have been joined solidly together.

In the hollow head main body 1, the sole portion 3 is formed of a heavy metal having a specific gravity which is 3.5 to 11 times the specific gravity of the metal of which the outer mold 4 is formed. In order to satisfy this specific gravity coefficient, titanium, aluminium, stainless steel or the like can preferably be used as the metal for the outer mold 4. For the sole portion 3, heavy metals having high specific gravity such as tantalum, tungsten or the like can preferably be used.

When the sole portion 3 is formed of one of the above-mentioned heavy metals having high specific gravity, the golf club head has a lower center of gravity. This facilitates lift when the ball is struck and increases ball flight distance. Furthermore, by using the heavy metal having high specific gravity for the sole portion 3, lowering in the center of gravity and an increase in the hollowness ratio can be achieved simultaneously without needing to increase the thickness of the sole portion 3 more than is necessary. Consequently, the sole portion 3 is distanced as far as possible from the center of gravity of the head, thereby enabling the moment of inertia around the center of gravity of the head to be increased. This increase in the moment of inertia around the center of gravity of the head enables shot stability to be improved.

In the present invention, the heavy metal for the sole portion 3 needs to have a specific gravity which is 3.5 to 11 times the specific gravity of the metal of which the outer mold 4 is formed. When the specific gravity of the sole portion 3 is less than 3.5 times the specific gravity of the outer mold 4, it is not possible to increase the moment of inertia around the center of gravity of the head while also lowering the center of gravity. Conversely, when the specific gravity of the sole portion 3 is greater than 11 times the specific gravity of the outer mold 4, it becomes difficult to select suitable materials. Furthermore, the sole portion 3 should preferably have a thickness of 2 to 3 mm. The sole portion 3 will be insufficiently strong if the thickness is less than 2 mm, and the increase in the moment of inertia described above will not be obtained if the thickness of the sole portion 3 exceeds 3 mm.

Figure 2:
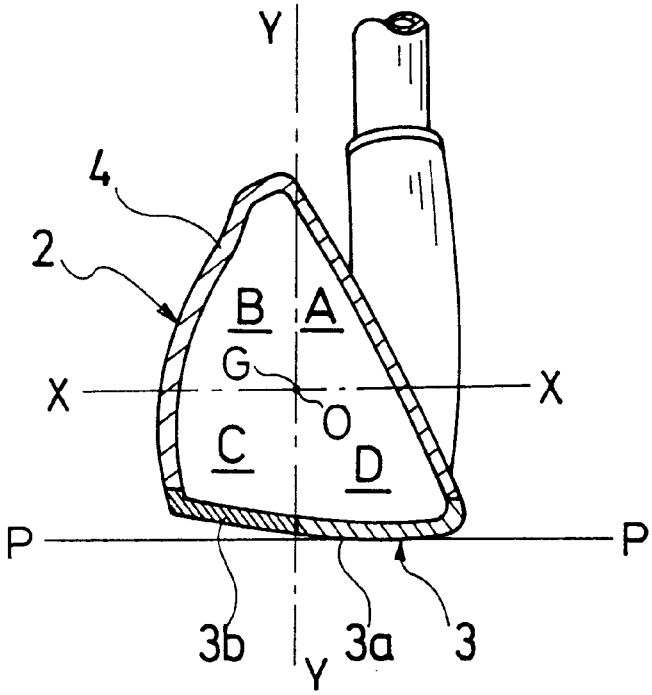
FIG. 2 is a vertical cross-sectional side view illustrating a long iron golf club head according to a second embodiment of the present invention.
Figure 3:
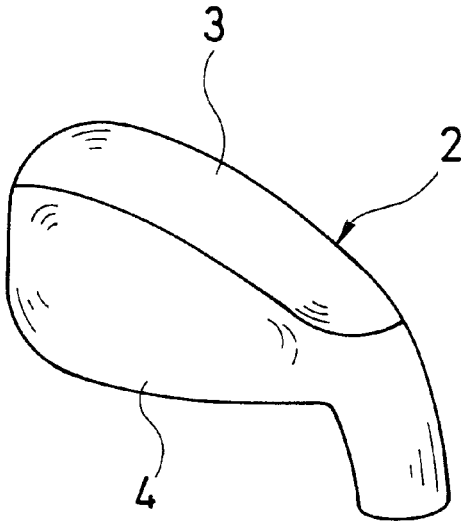
FIG. 3 is a diagonal bottom view of the golf club head depicted in FIG. 2.
Figure 4:
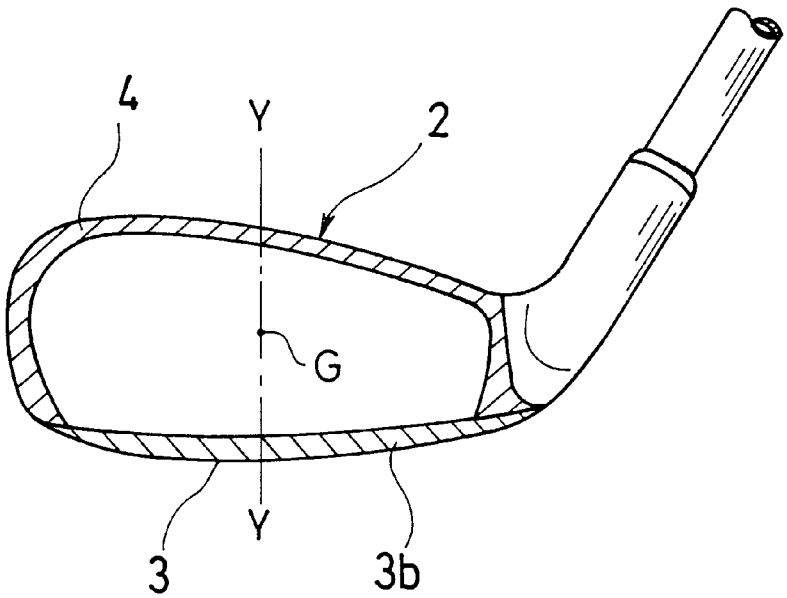
FIG. 4 is a vertical cross-sectional front view of the golf club head depicted in FIG. 2.

FIGS. 2 to 4 illustrate an embodiment of a long iron golf club head in which the present invention has been applied. In the diagrams, a head main body 2 has a hollow structure comprising a metallic sole portion 3 and a metallic outer mold 4 which have been joined solidly together.

Figure 5:
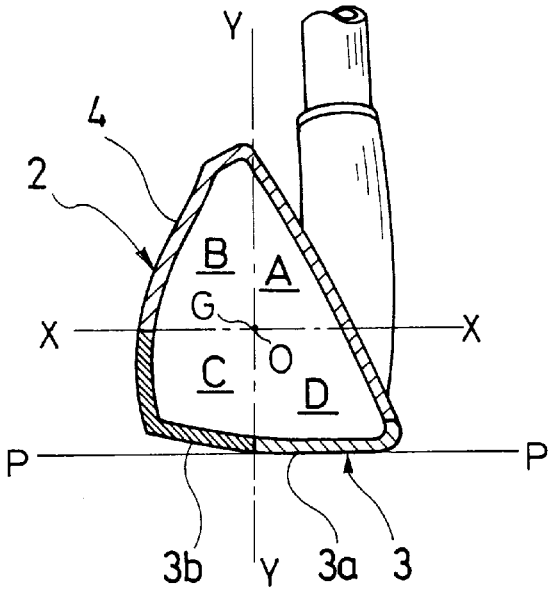
FIG. 5 is a vertical cross-sectional side view illustrating a long iron golf club head according to a third embodiment of the present invention.

As shown in FIG. 2, a coordinate system is supposed in which the center of gravity G is deemed as the origin O when the head main body 2 is placed in a stationary position on a horizontal plane surface including a horizontal line P—P, a line perpendicular to the horizontal plane surface, which passes through the origin O, is deemed as the Y axis, a line parallel to the plane surface and perpendicular to the leading edge of the head main body 2, which passes through the origin O, is deemed as the X axis, and it is composed of an upper right quadrant A, an upper left quadrant B, a lower left quadrant C and lower right quadrant D. In this coordinate system, the sole rear portion 3*b*, positioned in the lower left quadrant C which forms the segment below the X axis and to the back of the Y axis, is formed from a different metal than the sole front portion 3*a*. The shape of this sole rear portion 3*b* is not restricted to the ground region shown in FIG. 2, and can be extended to the height of the center of gravity position G as in the embodiment shown in FIG. 5.

In the above-mentioned hollow-structure head main body 2, the sole front portion 3*a* is formed of the same metal as that of the outer mold 4, but the sole rear portion 3*b* is formed of a heavy metal having a specific gravity which is 3.5 to 11 times the specific gravity of the metal of which the outer mold 4 is formed.

Since the sole rear portion 3*b* positioned within the lower left quadrant C according to the coordinate system above is selectively formed of a heavy metal having high specific gravity, the center of gravity of the head is shifted down and to the back side. In addition, the center of gravity of the head is lowered and the depth of the center of gravity is increased, thereby facilitating lift when a golf ball is struck. Furthermore, by using the heavy metal having a high specific gravity to form at least one part of the sole portion 3, lowering in the center of gravity of the head and an increase in the hollowness ratio of the head main body can be achieved simultaneously without increasing the thickness of the sole portion 3 more than is necessary. Consequently, it is possible to increase the moment of inertia around the center of gravity of the head which depends upon the sole portion 3, thereby enabling shot stability to be improved.

Figure 6:
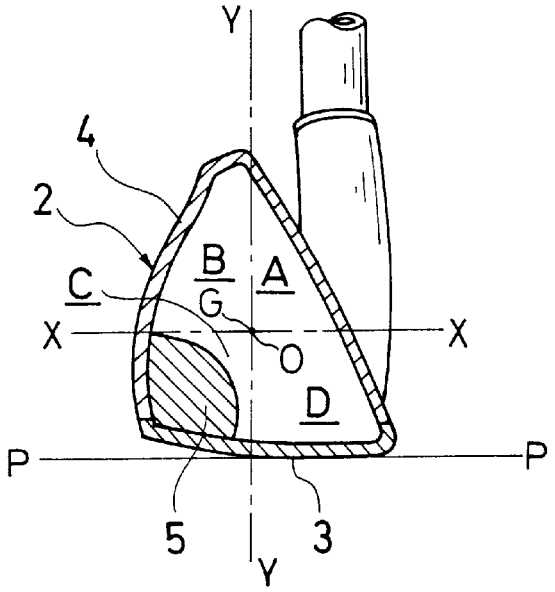
FIG. 6 is a vertical cross-sectional side view illustrating a long iron golf club head according to a fourth embodiment of the present invention.

FIG. 6 shows a long iron golf club head according to another embodiment of the present invention. In FIG. 6, the head main body 1 has a hollow structure comprising a metallic sole portion 3 and a metallic outer mold 4 which have been joined solidly together.

A weight 5 made of a heavy metal having a specific gravity of 3.5 to 11 times the specific gravity of the metal forming the head main body 2 has been provided to the inner surface of the sole portion 3. In order to satisfy this specific gravity coefficient, titanium, aluminium, stainless steel or the like should preferably be used as the metal for the head main body 2, and heavy metals having a high specific gravity such as tantalum, tungsten or the like should preferably be used as the metal for the weight 5. The weight 5 can be fitted by, for instance, providing a pin extending upwards from the inner surface of the sole portion 3. A fitting hole is provided in the weight 5, the pin is inserted through the fitting hole and is secured to the sole portion 3 by altering the shape of the tip of the pin by pressing.

With regard to setting the position of the weight 5, as shown in FIG. 6, a coordinate system is supposed in which the center of gravity G is deemed as the origin O when the head main body 2 is placed in a stationary position on a horizontal plane surface including a horizontal line P—P, a line perpendicular to the horizontal plane surface, which passes through the origin O, is deemed as the Y axis, a line parallel to the plane surface and perpendicular to the leading edge of the head main body 2, which passes through the origin O, is deemed as the X axis, and it is composed of an upper right quadrant A, an upper left quadrant B, a lower left quadrant C and lower right quadrant D. In this coordinate system, the weight 5 is positioned in the lower left quadrant C which forms the segment below the X axis and to the back of the Y axis.

Since the weight 5 within the lower left quadrant C according to the coordinate system above is made of a heavy metal having high specific gravity, the center of gravity of the head is shifted downwards and to the back side. In addition, the center of gravity of the head is lowered and the depth of the center of gravity is increased, thereby facilitating lift and improving shot stability when a golf ball is struck.

In the present invention, the heavy metal for the weight 5 needs to have a specific gravity which is 3.5 to 11 times the specific gravity of the metal of which the head main body 2 is formed. When the specific gravity of the weight 5 is 3.5 times or less the specific gravity of the head main body 2, it is not possible to effectively lower the center of gravity of the head or increase the depth of the center of gravity. Conversely, when the specific gravity of the weight 5 is greater than 11 times the specific gravity of the head main body 2, it becomes difficult to select suitable materials.

While there have been described what are at present considered to be preferred embodiments of the invention, it will be understood that various modifications may be made thereto, and it is intended that the appended claims cover all such modifications as fall within the true spirit and scope of the invention.

What is claimed is:

1. A golf club head comprising:

a hollow head main body having a front side, a rear side and center of gravity and comprising a metallic outer shell and a metallic sole portion molded solidly together, wherein at least part of the sole portion is formed of a heavy metal having a specific gravity of about 3.5 to 11 times the specific gravity of the metallic outer shell, wherein, when the head main body is placed on a horizontal plane surface, an X axis parallel to the horizontal plane surface and passing through the center of gravity, and a Y axis perpendicular to and intersecting the X axis at the center of gravity define cross-sectional quadrants including a lower rear quadrant adjacent the rear side of the main body, and wherein the sole portion formed of heavy metal is confined to the lower rear quadrant of the main body.

2. A golf club head according to claim 1, wherein said sole portion set has a thickness of about 2 to 3 mm.

3. A golf club head according to claim 1, wherein said metallic outer shell comprises a metal selected from at least one of titanium, aluminum and stainless steel.

4. A golf club head according to claim 1, wherein said heavy metal is selected from at least one of tantalum and tungsten.

* * * * *